US011081075B2

(12) United States Patent
Lee et al.

(10) Patent No.: US 11,081,075 B2
(45) Date of Patent: Aug. 3, 2021

(54) DISPLAY DEVICE

(71) Applicant: Samsung Display Co., Ltd., Yongin-Si (KR)

(72) Inventors: Hyunwook Lee, Asan-si (KR); Pilgyu Kang, Hwaseong-si (KR); Minchan Lee, Seoul (KR); Sungjin Lee, Yongin-si (KR); Chanyoung Lim, Cheonan-si (KR); Solip Jeong, Namyangju-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/353,994

(22) Filed: Mar. 14, 2019

(65) Prior Publication Data

US 2019/0287475 A1 Sep. 19, 2019

(30) Foreign Application Priority Data

Mar. 14, 2018 (KR) ..... 10-2018-0029952

(51) Int. Cl.
*G09G 3/36* (2006.01)

(52) U.S. Cl.
CPC ... *G09G 3/3677* (2013.01); *G09G 2320/0204* (2013.01)

(58) Field of Classification Search
CPC ..... G09G 3/36; G09G 3/3677; G09G 3/32
See application file for complete search history.

(56) References Cited

U.S. PATENT DOCUMENTS

| | | | | |
|---|---|---|---|---|
| 7,133,034 | B2 | 11/2006 | Park et al. | |
| 8,441,424 | B2 | 5/2013 | Lee | |
| 2006/0152245 | A1* | 7/2006 | Ahn | G09G 3/3648 324/760.02 |
| 2009/0102779 | A1 | 4/2009 | Jo | |
| 2016/0365051 | A1* | 12/2016 | Jung | G09G 3/3406 |
| 2016/0372025 | A1 | 12/2016 | Ahn et al. | |

FOREIGN PATENT DOCUMENTS

| | | | |
|---|---|---|---|
| KR | 10-0483384 | B1 | 8/2005 |
| KR | 10-0796787 | B1 | 1/2008 |
| KR | 10-1488197 | B1 | 2/2015 |
| KR | 10-1624501 | B1 | 6/2016 |
| KR | 10-2016-0149368 | A | 12/2016 |

* cited by examiner

*Primary Examiner* — Vijay Shankar
*Assistant Examiner* — Cory A Almeida
(74) *Attorney, Agent, or Firm* — Innovation Counsel LLP

(57) ABSTRACT

The present inventive concept is related to a display device in which a compensated voltage is applied to a gate line by compensating for a voltage drop of a voltage applied to the gate line.

23 Claims, 12 Drawing Sheets

DISPLAY DEVICE

CROSS-REFERENCE TO RELATED APPLICATION

This application claims priority under 35 U.S.C. § 119 to Korean Patent Application No. 10-2018-0029952, filed on Mar. 14, 2018, in the Korean Intellectual Property Office (KIPO), the disclosure of which is incorporated by reference herein in its entirety.

1. Technical Field

Embodiments of the present inventive concept relate to a display device, and more particularly, to a display device in which a compensated voltage is applied to a gate line by compensating for a voltage drop of the voltage applied to the gate line.

2. Discussion of Related Art

Display devices may be classified into liquid crystal display ("LCD") devices, organic light emitting diode ("OLED") display devices, plasma display panel ("PDP") devices, electrophoretic display devices, or the like based on a light emitting scheme thereof. The liquid display device includes pixels for driving liquid crystals, and each pixel includes a transistor connected to the liquid crystals. The transistor is connected to a data line and a gate line. The transistor operates according to a gate line voltage applied to the gate line to drive the liquid crystals connected to the pixel.

If a voltage drop occurs in the voltage applied to the gate line in accordance with the length of the line or a temperature change, a voltage actually applied to the transistor of the pixel becomes lower than the reference voltage, and thus the transistor of the pixel may not operate properly and the image quality may be degraded.

It is to be understood that this background of the technology section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY

Embodiments of the present inventive concept may be directed to a display device in which a compensated voltage is applied to a gate line by compensating for a voltage drop of a reference voltage applied to the gate line.

According to an embodiment, a display device includes: a gate line and a data line, the gate line being insulated from the data line and receiving a gate line reference voltage; a switch connected to one end of the gate line to output a gate line voltage that is voltage-dropped from the gate line reference voltage; and a gate line voltage compensator connected to the one end of the switch to collect the voltage-dropped gate line voltage for the gate line. The gate line voltage compensator calculates a voltage compensation value for the gate line by calculating a difference between the gate line reference voltage and the voltage-dropped gate line voltage for the gate line.

The gate line voltage compensator may collect the voltage for all of the gate lines during a first frame.

The gate line voltage compensator may collect the voltage for part of the gate lines during a first frame.

The gate line voltage compensator may collect the voltage for every n gate lines during the first frame, where n is equal to or greater than 2.

The switch may be one of a transistor and a diode.

The gate line reference voltage may be a DC voltage.

The gate line voltage compensator may calculate a compensated voltage by adding the voltage compensation value to the gate line reference voltage.

The gate line voltage compensator may calculate the compensated voltage periodically.

The gate line voltage compensator may calculate the compensated voltage to be applied to the gate line during a second frame.

The gate line voltage compensator may include a gate line reference voltage receiver connected to one end of the gate line, a gate line voltage receiver connected to another end of the gate line, a voltage compensation value calculator which calculates a difference between the gate line reference voltage and the voltage-dropped voltage during the first frame, and a compensation voltage calculator which calculates a compensation voltage for a second frame which succeeds the first frame. The compensation voltage may be a sum of the gate line reference voltage for the first frame and the voltage compensation value for the first frame.

According to an embodiment, a method of compensating for a gate line voltage includes: receiving a gate line reference voltage for a gate line; receiving a voltage that is voltage-dropped from the gate line reference voltage; collecting the voltage-dropped voltage for the gate line; and calculating a voltage compensation value for the gate line by calculating a difference between the gate line reference voltage and the voltage-dropped voltage for the gate line.

Collecting of the voltage-dropped voltage may include collecting the voltage for all of the gate lines.

Collecting of the voltage-dropped voltage may include collecting the voltage for part of the gate lines.

Outputting of the voltage-dropped voltage may be performed by a plurality of switches.

The switch may be one of a transistor and a diode.

The gate line reference voltage may be a DC voltage.

The method may further include calculating a compensated voltage by adding the voltage compensation value to the gate line reference voltage.

The compensated voltage may be applied to the gate line during a second frame.

Calculating of the compensated voltage may be performed periodically.

The foregoing is illustrative only and is not intended to be in any way limiting. In addition to the illustrative aspects, embodiments and features described above, further aspects, embodiments and features will become apparent by reference to the drawings and the following detailed description.

BRIEF DESCRIPTION OF THE DRAWINGS

A more complete appreciation according to an embodiment of the present inventive concept will become more apparent by describing in detail embodiments thereof with reference to the accompanying drawings, wherein.

DETAILED DESCRIPTION

Figure 1:
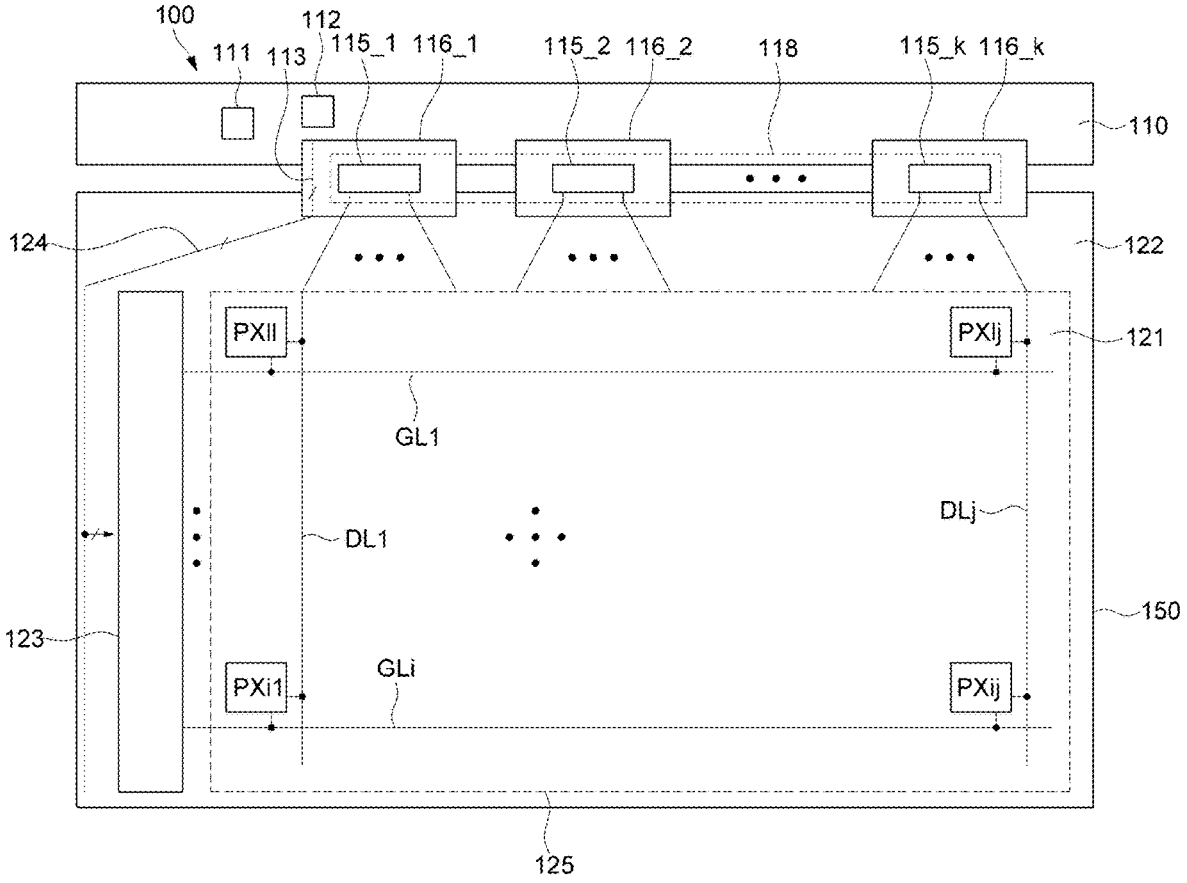
FIG. 1 is a view illustrating a display device.

Embodiments will now be described more fully hereinafter with reference to the accompanying drawings. Although the inventive concept may be modified in various manners and have several embodiments, embodiments are illustrated in the accompanying drawings and will be mainly described in the specification. However, the scope of the inventive concept is not limited to the embodiments and should be construed as including all the changes, equivalents and substitutions included in the spirit and scope of the inventive concept.

In the drawings, thicknesses of a plurality of layers and areas are illustrated in an enlarged manner for clarity and ease of description thereof. When a layer, area, or plate is referred to as being "on" another layer, area, or plate, it may be directly on the other layer, area, or plate, or intervening layers, areas, or plates may be present therebetween. Conversely, when a layer, area, or plate is referred to as being "directly on" another layer, area, or plate, intervening layers, areas, or plates may be absent therebetween. Further when a layer, area, or plate is referred to as being "below" another layer, area, or plate, it may be directly below the other layer, area, or plate, or intervening layers, areas, or plates may be present therebetween. Conversely, when a layer, area, or plate is referred to as being "directly below" another layer, area, or plate, intervening layers, areas, or plates may be absent therebetween.

The spatially relative terms "below", "beneath", "less", "above", "upper" or the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device positioned "below" or "beneath" another device may be placed "above" another device. Accordingly, the illustrative term "below" may include both the lower and upper positions. The device may also be oriented in the other direction and thus the spatially relative terms may be interpreted differently depending on the orientations.

Throughout the specification, when an element is referred to as being "connected" to another element, the element is "directly connected" to the other element, or "electrically connected" to the other element with one or more intervening elements interposed therebetween. It will be further understood that the terms "comprises," "including," "includes" and/or "including," when used in this specification, specify the presence of stated features, integers, steps, operations, elements and/or components, but do not preclude the presence or addition of one or more other features, integers, steps, operations, elements, components and/or groups thereof.

It will be understood that, although the terms "first," "second," "third," or the like may be used herein to describe various elements, these elements should not be limited by these terms. These terms are only used to distinguish one element from another element. Thus, "a first element" discussed below could be termed "a second element" or "a third element," and "a second element" and "a third element" may be termed likewise without departing from the teachings herein.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value.

Unless otherwise defined, all terms used herein (including technical and scientific terms) have the same meaning as commonly understood by those skilled in the art to which this inventive concept pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present specification.

Some of the parts which are not associated with the description may not be provided in order to specifically describe embodiments according to an embodiment of the present inventive concept and like reference numerals refer to like elements throughout the specification.

Hereinafter, a display device according to an embodiment of the present inventive concept will be described in detail with reference to FIGS. 1 to 11.

FIG. 1 is a view illustrating a display device.

A display device 100 according to an embodiment of the present inventive concept includes a display panel 150, a data driver 118, a gate driver 123, a circuit board 110, a power supplier 112, and a timing controller 111, as illustrated in FIG. 1.

The power supplier 112 and the timing controller 112 are positioned on the circuit board 110.

The timing controller 111 receives a vertical synchronization signal, a horizontal synchronization signal, an image data signal, and a reference clock signal, which are output from a graphic controller (not illustrated) provided in a system (not illustrated).

An interface circuit (not illustrated) is provided between the timing controller 111 and the system, and the aforementioned signals output from the system are input to the timing controller 111 through the interface circuit. The interface circuit may be embedded in the timing controller 111.

The timing controller 111 generates a gate control signal for controlling the gate driver 123 and a data control signal for controlling the data driver 118, using the vertical synchronization signal, the horizontal synchronization signal, and the reference clock signal.

The gate control signal may include clock signals, a vertical start signal, and a common reset control signal.

The data control signal may include a source start pulse, a source shift clock, a source output enable signal, a polarity signal, or the like.

In addition, the timing controller 111 rearranges the image data signals input from the system, and applies the rearranged image data signals to the data driver 118.

The display panel 150 includes a display area 121 and a non-display area 122.

The display panel 150 may be a panel used for various kinds of display devices such as liquid crystal display ("LCD") panels or organic light emitting diode ("OLED") panels.

The display panel 150 includes a plurality of data lines DL1 to DLj, a plurality of gate lines GL1 to GLi, and a plurality of pixels PX11 to PXij, where i and j each are a natural number greater than 1.

The data lines DL1 to DLj cross the gate lines GL1 to GLi. The data lines DL1 to DLj extend to the non-display area 122 to be connected to the data driver 118.

The data driver 118 includes a plurality of data driving integrated circuits ("ICs") 115_1, 115_2, . . . and **115_*k*. The data driving ICs 115_1, 115_2, . . . and 115_*k* receive the digital image data signals and the data control signal applied from the timing controller 111**.

The data driving ICs 115_1, 115_2, . . . and **115_*k* sample the digital image data signals according to the data control signal, latch the sampled digital image data signals corresponding to one horizontal line in each horizontal period, and apply the latched image data signals to the data lines DL1 to DLj. For example, the data driving ICs 115_1, 115_2, . . . and 115_*k* convert the digital image data signals applied from the timing controller 111 into analog image signals using a gamma voltage input from the power supplier 112, and apply the converted analog image signals to the data lines DL1** to DLj.

The data driving ICs 115_1, 115_2, . . . and **115_*k* are mounted on data carriers 116_1, 116_2, . . . and 116_*k*, respectively. The data carriers 116_1, 116_2, . . . and 116_*k* are connected between the circuit board 110 and the display panel 150. For example, each of the data carriers 116_1, 116_2, . . . and 116_*k* may be electrically connected between the circuit board 110 and the non-display area 122 of the display panel 150**.

The data carriers 116_1, 116_2, . . . and **116_*k* include input wirings for transmitting various signals applied from the timing controller 111 and the power supplier 112 to the data driving ICs 115_1, 115_2, . . . and 115_*k*, and output wirings for transmitting the image data signals output from the data driving ICs 115_1, 115_2, . . . and 115_*k* to the corresponding ones of the data lines DL1 to DLj. In an embodiment, at least one carrier 116_1 may further include auxiliary wirings 113 for transmitting various signals applied from the timing controller 111 and the power supplier 112 to the gate driver 123. The auxiliary wirings 113 are connected to panel wirings 124 located at the display panel 150. The panel wirings 124 connect the auxiliary wirings 113 and the gate driver 123 to each other. The panel wirings 124 may be formed on the non-display area 122 of the display panel 150** in a line-on-glass manner.

The pixels PX11 to PXij are disposed in the display area 121 of the display panel 150. The pixels PX11 to PXij are arranged in a matrix form. The pixels PX11 to PXij may include red pixels displaying a red image, green pixels displaying a green image and blue pixels displaying a blue image. In such an embodiment, the red pixel, the green pixel and the blue pixel that are adjacently disposed in a horizontal direction may constitute a unit pixel for displaying a unit image.

There are "j" number of pixels arranged along a p-th (p being one selected from 1 to i) horizontal line (hereinafter, p-th horizontal line pixels), which are connected to the first to jth data lines DL1 to DLj, respectively. Further, the p-th horizontal line pixels are connected in common to the p-th gate line. Accordingly, the p-th horizontal line pixels receive a p-th gate signal as a common signal. That is, "j" number of pixels disposed in the same horizontal line receive the same gate signal, while pixels disposed in different horizontal lines receive different gate signals, respectively. Herein, p is a natural number equal to or greater than 1 and equal to or less than i.

Although not illustrated, each of the pixels may include a pixel transistor, a liquid crystal capacitor, and a storage capacitor. The pixel transistor is a thin film transistor, for example.

The pixel transistor is turned on according to a gate signal applied from the gate line. The turned-on pixel transistor applies the analog image data signal applied from the data driver to the liquid crystal capacitor and the storage capacitor.

The liquid crystal capacitor includes a pixel electrode and a common electrode which oppose each other.

The storage capacitor includes a pixel electrode and an opposing electrode which oppose each other. Herein, the opposing electrode may be a previous gate line or a transmission line which transmits a common voltage.

The gate lines GL1 to GLi are driven by the gate driver 123, and the gate driver 123 includes a shift register.

The clock signals from the timing controller 111 and off voltages from the power supplier 112 are applied to the shift register of the gate driver 123 through the auxiliary wirings 113 and the panel wirings 124.

Figure 2:
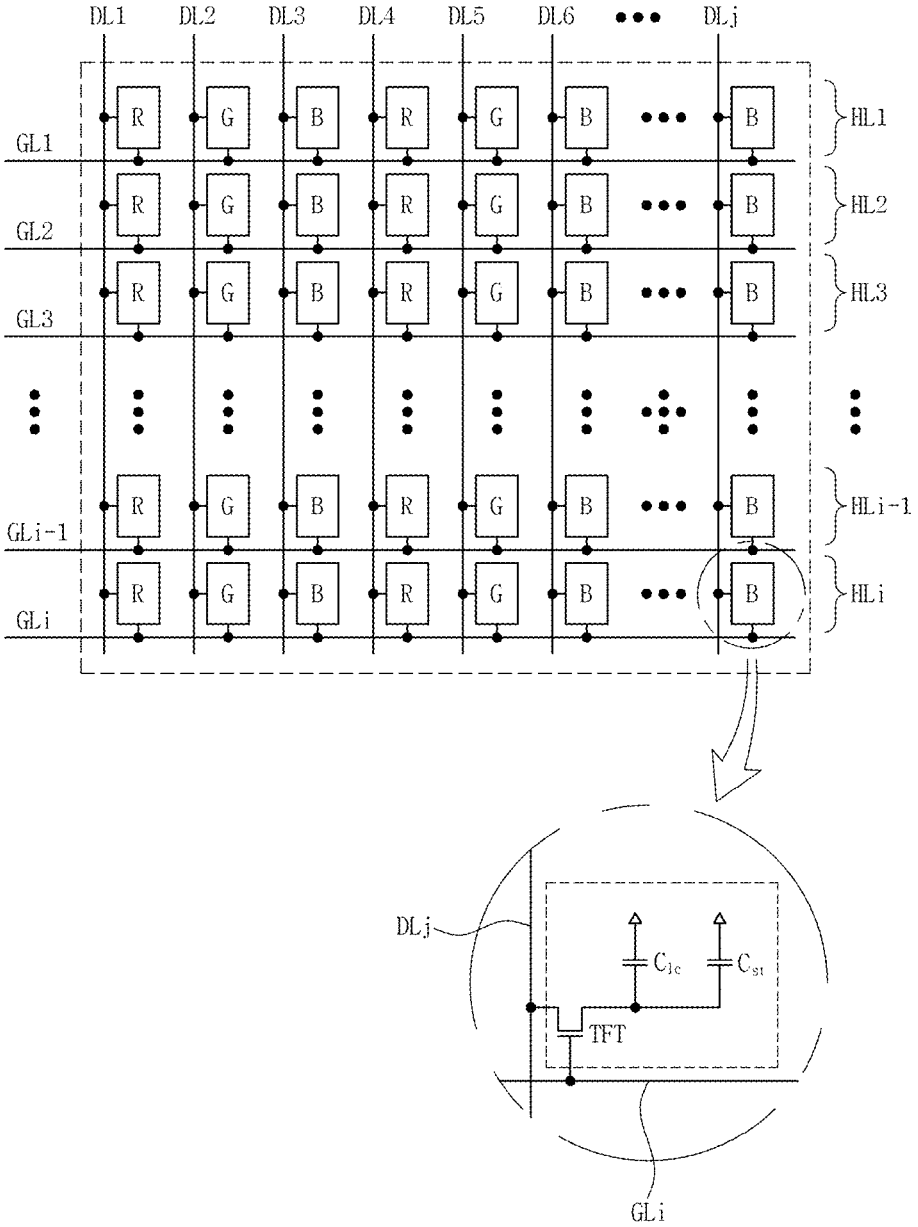
FIG. 2 is a view schematically illustrating pixels included in a display panel of FIG. 1.

FIG. 2 is a view schematically illustrating pixels included in a display panel of FIG. 1.

The display panel 150 includes a plurality of pixels R, G, and B, as illustrated in FIG. 2. The pixels R, G and B are located in the display area of the display panel 150, as illustrated in FIG. 2.

The pixels R, G, and B are arranged in a matrix form. The pixels R, G, and B include red pixels R displaying red images, green pixels G displaying green images, and blue pixels B displaying blue images. In such an embodiment, the red pixel R, the green pixel B and the blue pixel B that are adjacently disposed in a horizontal direction may constitute a unit pixel for displaying a unit image.

There are "j" number of pixels arranged along an n-th (n being one selected from 1 to i) horizontal line (hereinafter, n-th horizontal line pixels), which are individually connected to the first to j-th data lines DL1 to DLj, respectively. In addition, the n-th horizontal line pixels are connected in common to an n-th gate line. Accordingly, the n-th horizontal line pixels receive an n-th gate signal as a common signal. That is, "j" number of pixels disposed in the same horizontal line all receive the same gate signal, while pixels disposed in different horizontal lines receive different gate signals, respectively. For example, the red pixel R, the green pixel G and the blue pixel B in a first horizontal line HL1 all receive a first gate signal, while the red pixel R, the green pixel G and the blue pixel B in a second horizontal line HL2 all receive a second gate signal that has an output timing which is different from an output timing of the first gate signal.

Each of the pixels R, G, and B includes a switch TFT, a liquid crystal capacitor $C_k$, and a storage capacitor $C_{st}$, as illustrated in FIG. 2. The switch TFT may be a thin film transistor, for example.

The switch TFT is turned on according to the gate signal applied from the gate line GLi. The turned-on switch TFT applies the analog image data signals applied from the data driver through the data line DLj to the liquid crystal capacitor $C_k$ and the storage capacitor $C_{st}$.

The liquid crystal capacitor $C_{st}$ includes a pixel electrode and a common electrode which oppose each other.

The storage capacitor $C_{st}$ includes a pixel electrode and an opposing electrode which oppose each other. Herein, the opposing electrode may be a previous gate line GLi−1 or a transmission line (not illustrated) for transmitting a common voltage.

Figure 3:
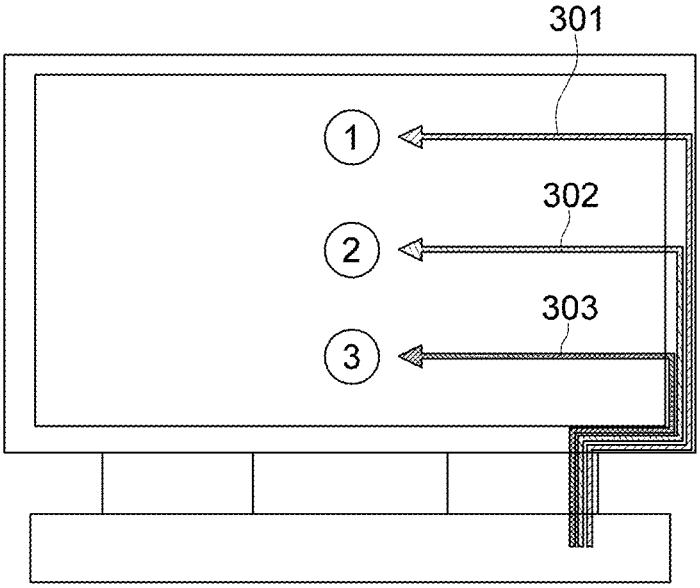
FIG. 3 is a view schematically illustrating a length of a gate line depending on a location in the display panel.

FIG. 3 is a view schematically illustrating a length of a gate line depending on a location in the display panel.

A gate line voltage transmitted through the gate line and a data voltage transmitted through the data line are applied to the thin film transistor, constituting the pixel, during one frame. The thin film transistor is turned on or off according to the gate line voltage, and the data voltage applied to the pixel electrode adjusts the direction of liquid crystals according to the data voltage.

A voltage when the gate of the thin film transistor is turned on is called a turn-on voltage, and a voltage when it is turned off is called a turn-off voltage.

The gate line connected to the thin film transistor of each pixel includes a resistance component and a capacitor component. Accordingly, the transistor of each pixel receives the voltage that is voltage-dropped and delayed according to the resistance component and the capacitor component, not the voltage initially applied to the gate line. This occurs irrespective of whether the component of the thin film transistor is low temperature polycrystalline silicon, amorphous silicon, or oxide.

Referring to FIG. 3, the amount of voltage drop varies depending on the length of the gate line. That is, as the length of the gate line becomes longer, the amount of voltage drop increases. A voltage drop occurring in a longest gate line 301 is greater than voltage drops occurring in other gate lines 302 and 303.

Figure 4:
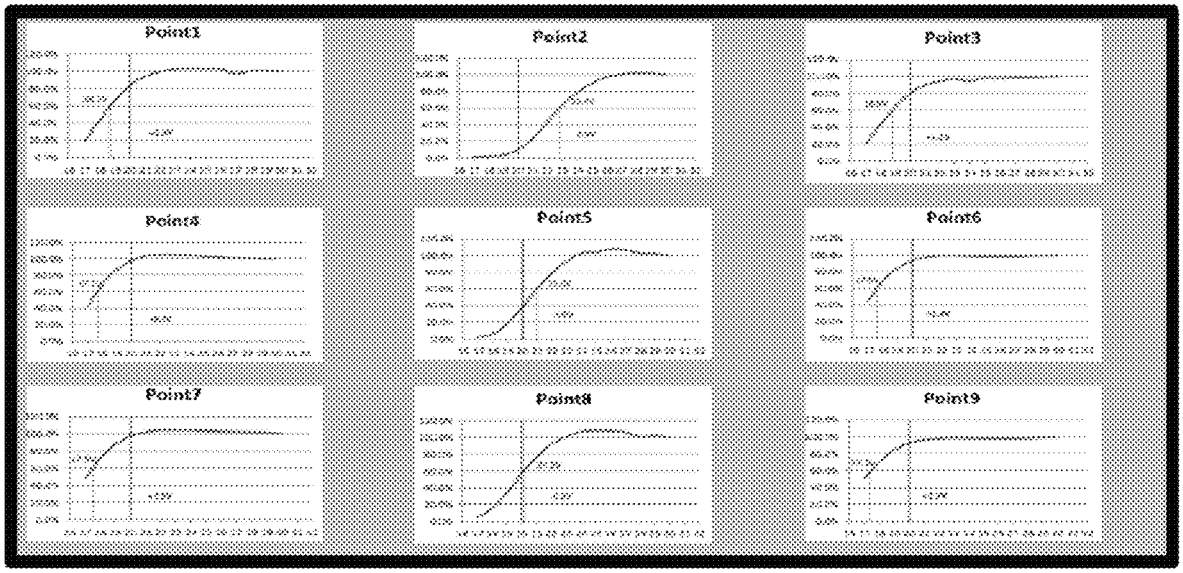
FIG. 4 is a view illustrating the voltage drop of the gate line voltage in a display device depending on the length of the gate line.

FIG. 4 is a view illustrating the voltage drop of the gate line voltage in a display device depending on the length of the gate line. In FIG. 4, luminance of each area depending on the voltage is shown for the areas from Point 1 to Point 9. With respect to the gate voltage of 20 V, other areas except for the central area reach a luminance of about 60% before the gate line voltage reaches 20 V, but the central area reaches a luminance of about 60% at a voltage substantially equal to or higher than 20 V because a voltage drop occurs in the central area.

In an embodiment, the ion output amount of the thin film transistor is reduced at a relatively low temperature, thus lowering the performance, and when the gate line voltage rises, the ion output amount also increases. Accordingly, in order for the thin film transistor to perform to its original capability at a relatively low temperature, the gate line voltage applied at a low temperature should be higher than that at room temperature.

Figure 5:
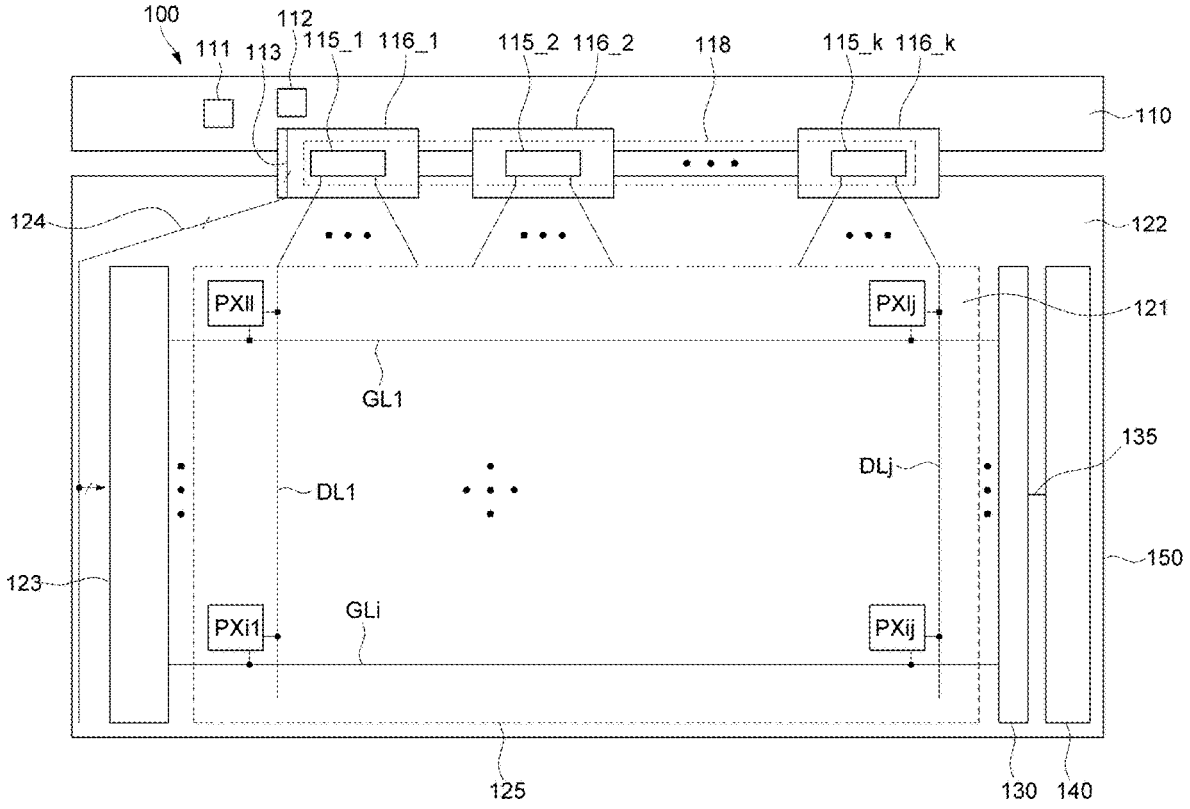
FIG. 5 is a view illustrating a display panel including a gate line voltage compensator of a display device according to an embodiment of the present inventive concept.

FIG. 5 is a view illustrating a display panel including a gate line voltage compensator of a display device according to an embodiment of the present inventive concept. The descriptions on configurations the same as those of FIG. 1 will be omitted in order to avoid redundancy.

A switch circuit 130 is connected to an end of the gate line for feedback the voltage, which is voltage-dropped in the gate line, to a gate line voltage compensator 140. The switch circuit 130 includes a plurality of switches 603. The switches 603 may be a transistor or a diode. The switch circuit 130 is connected to the gate line voltage compensator 140 by a feedback line 135. The voltages that have been initially applied to the gate line for turning on the switch (a gate line reference voltage) and the gate voltages which are voltage-dropped due to a resistance component and a capacitor component are sequentially applied to the gate line voltage compensator 140 through the feedback line 135. The gate line voltage compensator 140 sequentially collects the gate voltages which are voltage-dropped during one frame. The gate line voltage compensator 140 calculates a voltage to be applied to the gate line during a succeeding frame by calculating a difference between the voltage-dropped gate line voltage and the gate line reference voltage to obtain a voltage compensation value, and then adding the voltage compensation value to the gate line reference voltage. Then, the gate line voltage compensator 140 applies the calculated voltage to the gate driver 123.

Figure 6A:
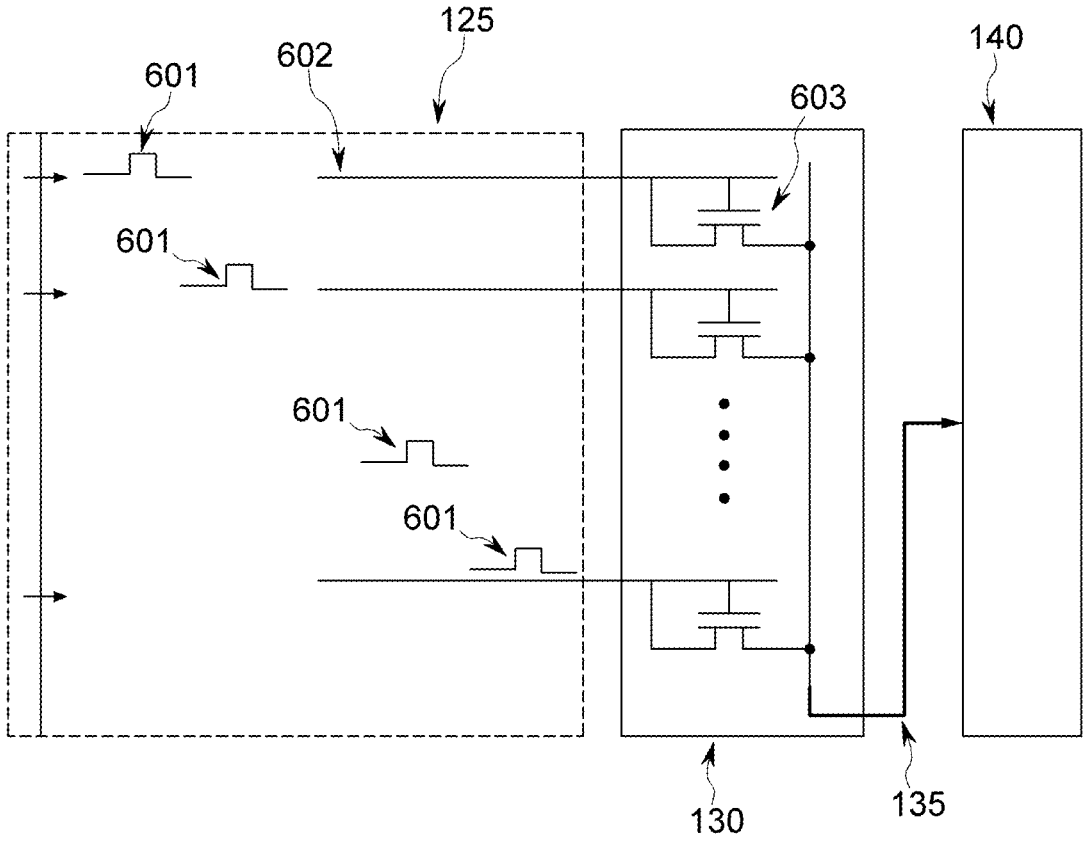
FIG. 6A is a view illustrating a display panel including a gate line voltage compensator of a display device according to an embodiment of the present inventive concept.

FIG. 6A is a view illustrating a display panel including a gate line voltage compensator of a display device according to an embodiment of the present inventive concept. Referring to FIG. 6A, a gate reference voltage 601 is applied to each of gate lines 602.

The gate reference voltage is sequentially applied to each of the gate lines in a display area 125 during one frame. The gate reference voltage applied to the gate line is applied to a gate of the thin film transistor of each pixel connected along the gate line. A voltage drop occurs in the voltage applied along the gate line, and the voltage-dropped voltage is applied to the thin film transistor of each pixel.

In an embodiment, the switch circuit 130 is connected to an end of the gate line to feedback the voltage that is voltage-dropped in the gate line to the gate line voltage compensator 140. The switch circuit 130 includes the plurality of switches 603. The switches 603 may be a transistor or a diode.

One end of the switch 603 is connected to the gate line 602, and another end of the switch 603 is connected to the gate line voltage compensator 140. The switch 603 is turned on when the voltage-dropped voltage which is greater than a threshold voltage of the switch is applied from the gate line 602, and is turned off otherwise. The switch 603 sequentially transmits the voltage that is voltage-dropped in the gate line 602 to the feedback line 135, and the transmitted voltage is applied to the gate line voltage compensator 140.

Figure 6B:
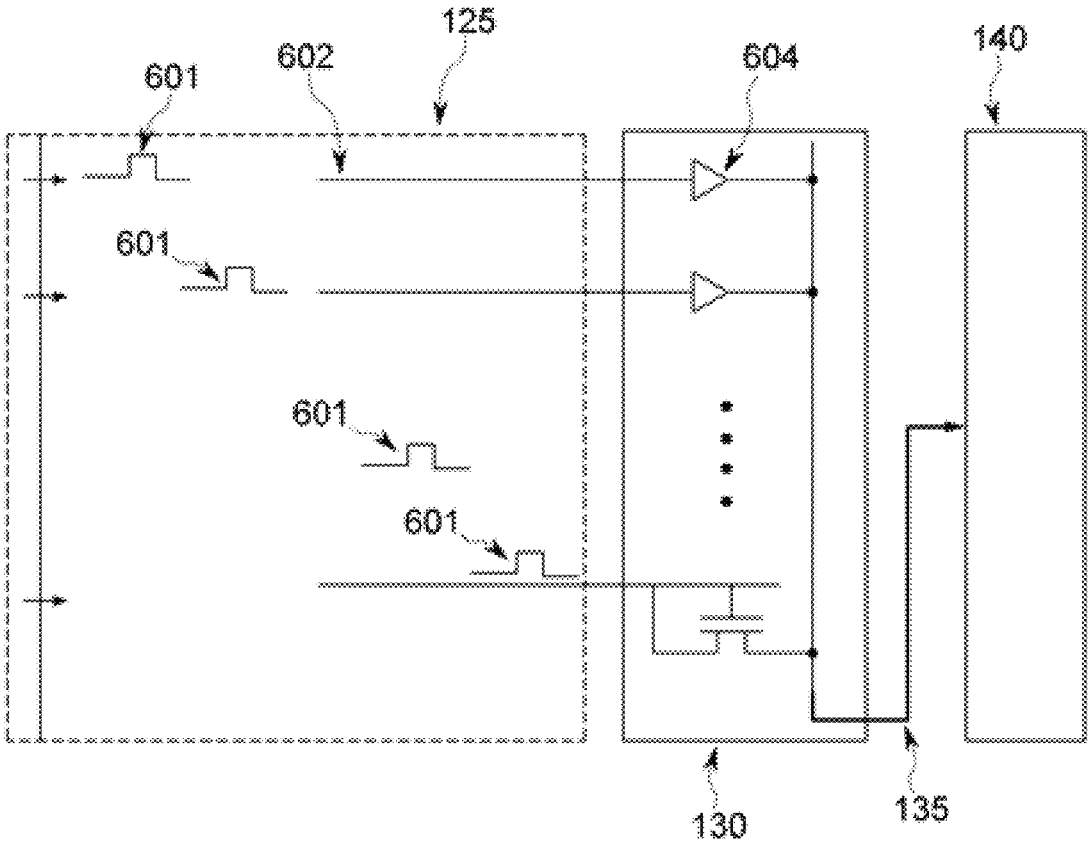
FIG. 6B is a view illustrating a display panel including a gate line voltage compensator of a display device according to another embodiment of the present inventive concept.

FIG. 6B is a view illustrating a display panel including a gate line voltage compensator of a display device according to another embodiment of the present inventive concept. Referring to FIG. 6B, the switch circuit 130 includes a diode 604. The diode 604 performs the same function as the transistor of FIG. 6A.

Figure 7A:
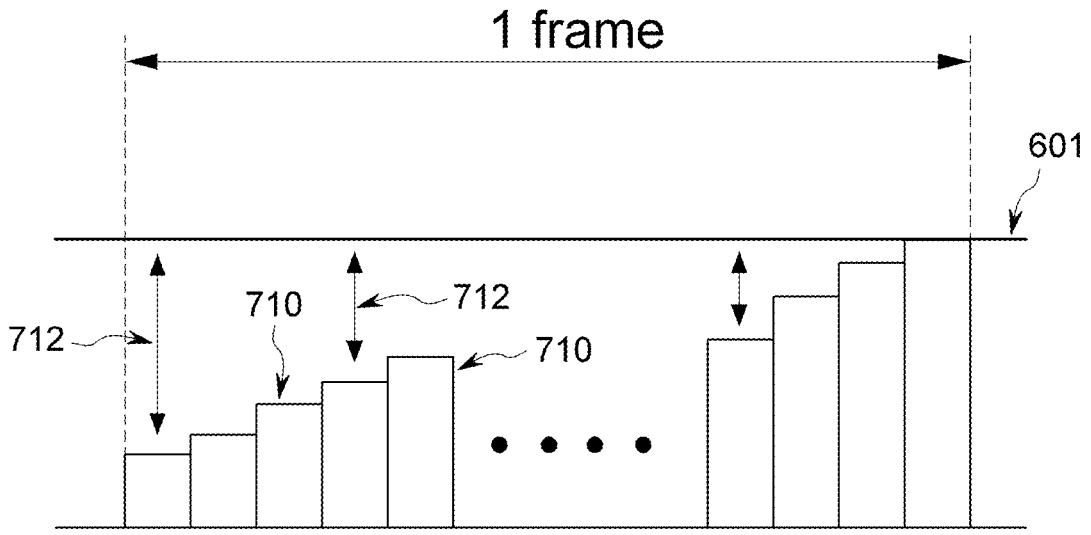
FIGS. 7A and 7B are diagrams showing a method of compensating for the gate line voltage of a display device according to an embodiment of the present inventive concept.
Figure 7B:
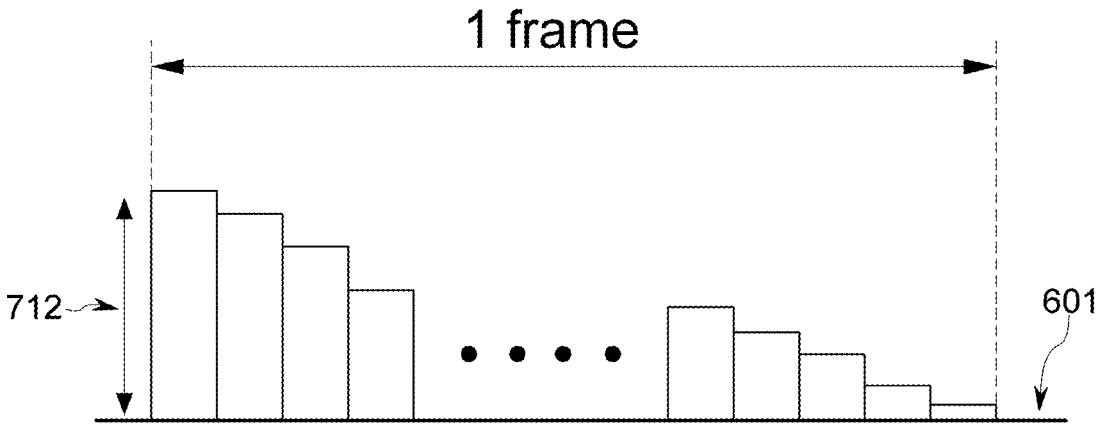

FIGS. 7A and 7B are diagrams showing a method of compensating for the gate line voltage of a display device according to an embodiment of the present inventive concept. Referring to FIGS. 6, 7A, and 7B, the gate line reference voltage 601 is applied to each gate line of the display device. The gate line reference voltage 601 may be a DC voltage or a square wave. The respective gate lines of the display device are connected to the gate line voltage compensator 140 through the plurality of switches 603, and the plurality of switches 603 are connected to the gate lines, respectively, to feedback the voltage-dropped voltage to the gate line voltage compensator 140. The gate line voltage compensator 140 collects a voltage-dropped voltage 710 during one frame, and calculates a voltage compensation value by calculating a difference 712 between the gate line reference voltage 601 and the voltage-dropped voltage 710 during one frame.

The gate line voltage compensator adds the voltage compensation value, which is the difference 712 between the gate line reference voltage 601 and the voltage-dropped voltage 710, to the gate line reference voltage 601 during a succeeding frame. For example, in the case where the reference voltage of about 20 V is applied to the gate line on the upper left portion and the voltage of about 18.7 V is input to the gate line voltage compensator 140 due to a voltage drop, the difference between the gate line reference voltage and the voltage-dropped voltage is about 1.3 V. This voltage-dropped voltage of about 1.3 V is added to the reference voltage of about 20 V, and the voltage of about 21.3 V becomes the compensated voltage to be applied to the gate line in the succeeding frame.

When the voltage of about 21.3 V is applied to the gate line in the succeeding frame accordingly, even if the voltage drop of about 1.3 V occurs, the actual voltage of greater than 20 V is applied to the gate line as the gate line voltage, so that a voltage greater than the reference voltage may be applied as the gate line voltage. By performing such gate line voltage compensation for all gate lines in such a manner, the gate line voltage compensator may apply a compensated reference voltage to all gate lines.

In an embodiment, in the case where the gate line voltage compensator cannot apply a compensated reference voltage to all the gate lines, the gate line voltage compensation may be performed for only part of the gate lines to apply a compensated reference voltage thereto. In the case of the top portion of the display device (① of FIG. 3 which is connected to longest gate line 301), since the gate line is relatively lengthened as compared to the length of the gate line in the bottom portion or the middle portion of the display device, the gate line voltage compensation may be performed only on the gate lines in the top portion.

Accordingly, although the gate line voltage of only part of the gate lines is compensated, the uniform image quality may be achieved without degrading the image quality.

Figure 8:
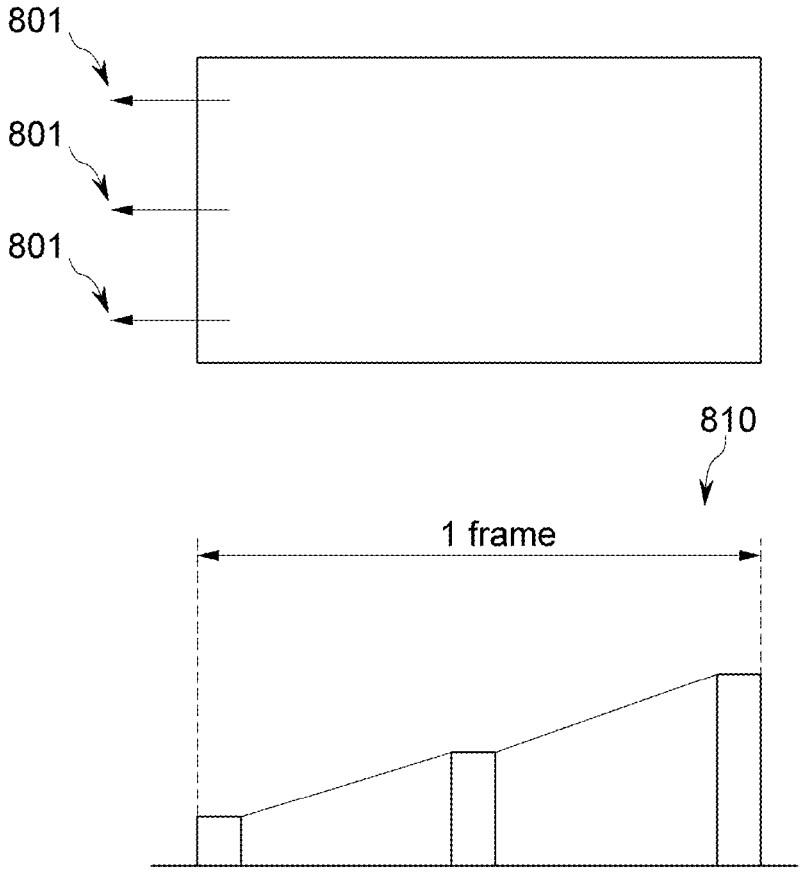
FIGS. 8 and 9 are diagrams showing sampling points in a method of compensating for the gate line voltage for a display device according to an embodiment of the present inventive concept.
Figure 9:
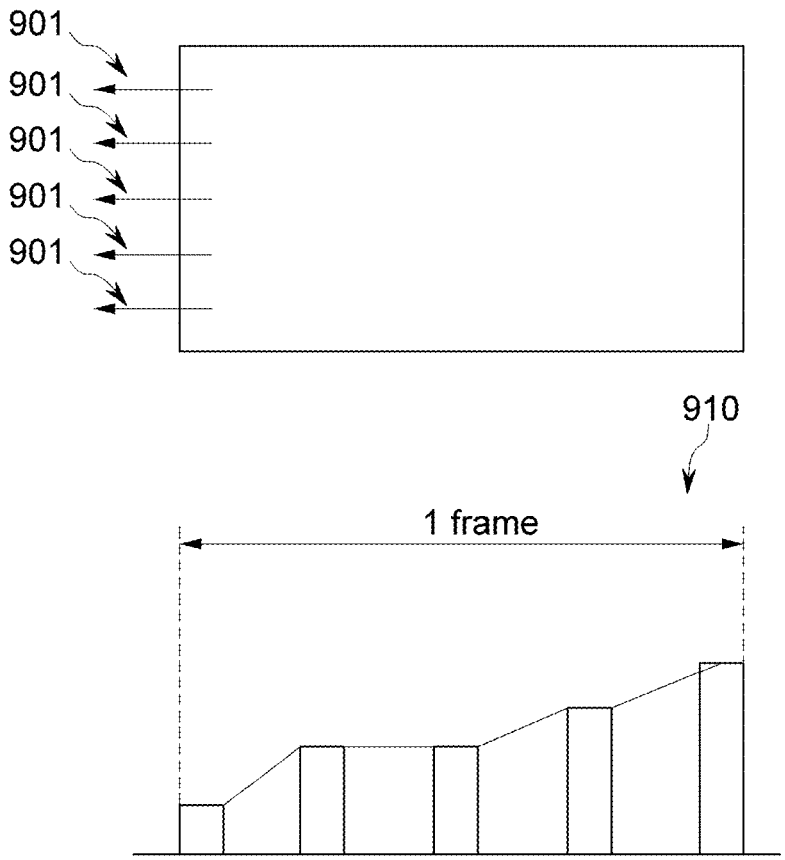

FIGS. 8 and 9 are diagrams showing sampling points in the method of compensating for the gate line voltage for a display device according to an embodiment of the present inventive concept. Referring to FIGS. 8 and 9, the sampling point in the method of compensating for the gate line voltage according to an embodiment of the present inventive concept may be some points (e.g., part of the gate lines), rather than the entirety of the gate lines.

The part of the gate lines may be three points 801 at the top, middle, and bottom, or may be five points 901 at the top, middle, bottom, a point between the top and middle, and a point between the middle and bottom. Since the gate line voltages are collected during one frame, the voltages of the part of the gate lines are discrete in time (i.e., temporarily spaced apart from each other) during one frame (810 and 910).

Figure 10:
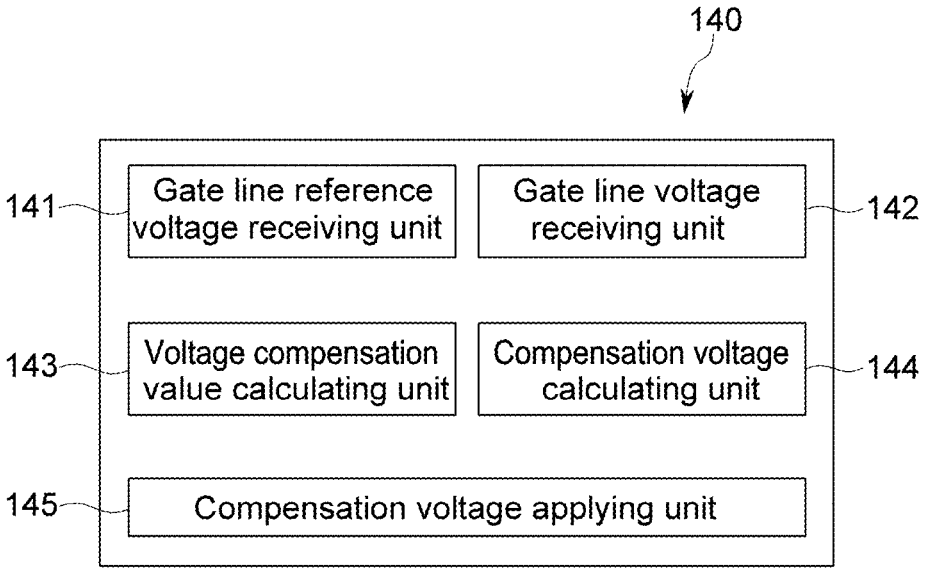
FIG. 10 is a view illustrating a gate line voltage compensator of a display device according to an embodiment of the present inventive concept.

FIG. 10 is a view illustrating a gate line voltage compensator of a display device according to an embodiment of the present inventive concept.

The gate line voltage compensator 140 includes a gate line reference voltage receiver 141, a gate line voltage receiver 142, a voltage compensation value calculator 143, a compensated voltage calculator 144, and a compensated voltage source 145. The gate line reference voltage receiver 141 collects the reference voltage applied to the gate.

The gate line voltage receiver 142 collects the gate line voltage that is voltage-dropped from the reference voltage 601 during each frame.

The voltage compensation value calculator 143 calculates the voltage compensation value by obtaining a difference between the reference voltage 601 and the voltage collected from the gate line.

The compensated voltage calculator 144 calculates the compensated voltage by adding the voltage compensation value to the reference voltage 601.

The compensated voltage source 145 transmits the voltage to be applied to the gate line during the succeeding frame, by applying the compensated voltage to the gate driver 123.

Figure 11:
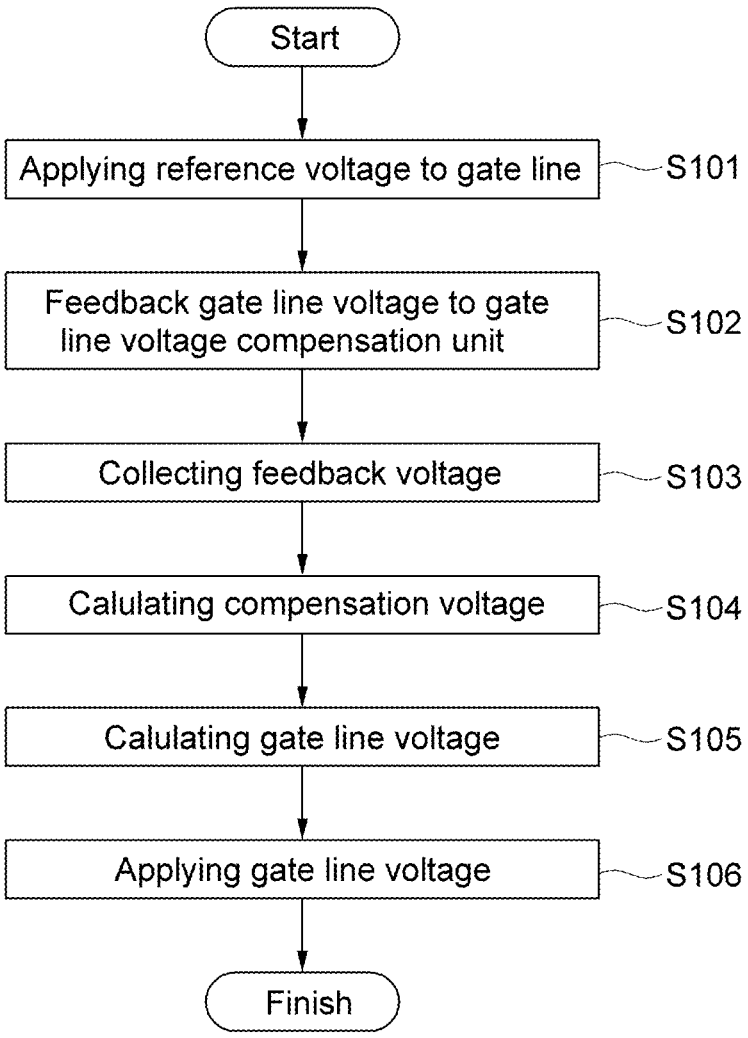
FIG. 11 is a flowchart showing a method of compensating for the gate line voltage of a display device according to an embodiment of the present inventive concept.

FIG. 11 is a flowchart showing a method of compensating for the gate line voltage of a display device according to an embodiment of the present inventive concept. Referring to FIG. 11, when the display device is driven, the reference voltage is applied to the gate line during a first frame of an image (S101). In such an embodiment, the reference voltage may be a DC voltage or a square wave.

The switch connected to each gate line feedbacks the voltage, voltage-dropped in the gate line, to the gate line voltage compensator 140 (S102).

The gate line voltage compensator is connected to each of the gate lines, and collects the voltage that is fedback to the gate line voltage compensator (S103). The gate line voltage compensator 140 collects the feedback voltage for the entirety of the gate lines or for part of the gate lines during one frame.

The gate line voltage compensator 140 calculates the voltage compensation value by calculating a difference between the reference voltage and the feedback voltage (S104). The voltage compensation value is calculated for the entirety of the gate line voltages or for part of the gate line voltages that are fedback.

The gate line voltage compensator 140 calculates the compensated gate line voltage to be applied to the succeeding frame, by adding the voltage compensation value to the reference voltage which may be a reference voltage of a previous frame (S150). The new gate line voltage is applied to the entirety of the gate lines or part of the gate lines in the succeeding frame (S106).

The gate line voltage compensation process may be performed at regular periods. That is, the gate line voltage compensation process may be performed every several frames or several tens of frames. The period may be specified by the number of frames or time.

The method of compensating for the gate line voltage according to an embodiment of the present inventive concept may compensate for the voltage drop of the reference voltage due to the resistance component and the capacitor component of the gate line and due to the low temperature.

In addition, the method of compensating for the gate line voltage according to an embodiment of the present inventive concept may allow all or part of the gate lines of the display device to apply a compensated reference voltage which compensates voltage drop.

As set forth hereinabove, in the display device according to one or more embodiments of the present inventive concept, the switch connected to the gate line feedbacks the voltage that is voltage-dropped in the gate line to the gate line voltage compensator, and the gate line voltage compensator compensates for the voltage that is voltage-dropped in the gate line, and thus all or part of the gate lines of the display device may maintain a appropreated reference voltage While the present inventive concept has been illustrated and described with reference to the embodiments thereof, it will be apparent to those of ordinary skill in the art that various changes in form and detail may be formed thereto without departing from the spirit and scope according to an embodiment of the present inventive concept.

What is claimed is:

1. A display device comprising:

a gate line and a data line, the gate line being insulated from the data line and receiving a gate line reference voltage;

a switch including a gate electrode and a drain electrode commonly connected to one end of the gate line; and a gate line voltage compensator connected to a source electrode of the switch to receive a voltage-dropped gate line voltage for the gate line only when a voltage greater than a threshold voltage of the switch is applied to the gate electrode of the switch, wherein the gate line voltage compensator calculates a voltage compensation value for the gate line by calculating a difference between the gate line reference voltage and the voltage-dropped gate line voltage for the gate line, and wherein:

the gate line is the longest gate line among a plurality of gate lines, and only the longest gate line among the plurality of the gate lines is selectively connected to the switch and the gate line voltage compensator.

2. The display device of claim 1, wherein the gate line voltage compensator collects the voltage for all of the gate lines during a first frame.

3. The display device of claim 1, wherein the gate line voltage compensator collects the voltage for part of the gate lines during a first frame.

4. The display device of claim 3, wherein the gate line voltage compensator collects the voltage for every n gate lines during the first frame, where n is equal to or greater than 2.

5. The display device of claim 1, wherein the switch is one of a transistor and a diode.

6. The display device of claim 1, wherein the gate line reference voltage is a DC voltage.

7. The display device of claim 1, wherein the gate line voltage compensator calculates a compensated voltage by adding the voltage compensation value to the gate line reference voltage.

8. The display device of claim 7, wherein the gate line voltage compensator calculates the compensated voltage periodically.

9. The display device of claim 7, wherein the gate line voltage compensator calculates the compensated voltage to be applied to the gate line during a second frame.

10. The display device of claim 1, wherein the gate line voltage compensator comprises:

a gate line reference voltage receiver connected to one end of the gate line;

a gate line voltage receiver connected to another end of the gate line;

a voltage compensation value calculator which calculates a difference between the gate line reference voltage and the voltage-dropped voltage during the first frame; and a compensation voltage calculator which calculates a compensation voltage for a second frame which succeeds the first frame, wherein the compensation voltage is a sum of the gate line reference voltage for the first frame and the voltage compensation value for the first frame.

11. The display device of claim 1, wherein the switch is disposed within a non-display area of a display panel.

12. The display device of claim 1, wherein the switch is not connected to the data line.

13. The display device of claim 1, further comprising a display panel on which the gate and data lines are disposed; and a gate driver providing the gate line reference voltage;

wherein:

the gate driver is disposed on one side of the display panel, the gate driver is connected to the other end of the gate line, the gate line voltage compensator is disposed on the other side of the display panel, and the other side of the display panel faces the one side of the display panel.

14. The display device of claim 1, wherein the longest gate line is disposed in a top portion of the display device.

15. A method of compensating for a gate line voltage, the method comprising:

receiving a gate line reference voltage for a gate line;

receiving a voltage that is voltage-dropped from the gate line reference voltage through a switch including a gate electrode and a drain electrode commonly connected to one end of the gate line;

receiving the voltage-dropped voltage for the gate line from a source electrode of the switch only when a voltage greater than a threshold voltage of the switch is applied to the gate electrode of the switch; and calculating a voltage compensation value for the gate line by calculating a difference between the gate line reference voltage and the voltage-dropped voltage for the gate line, wherein:

the gate line is the longest gate line among a plurality of gate lines, and only the longest gate line among the plurality of the gate lines is selectively connected to the switch and the gate line voltage compensator.

16. The method of claim 15, wherein collecting of the voltage-dropped voltage comprises collecting the voltage for all of the gate lines.

17. The method of claim 15, wherein collecting of the voltage-dropped voltage comprises collecting the voltage for part of the gate lines.

18. The method of claim 15, wherein outputting of the voltage-dropped voltage is performed by a plurality of switches.

19. The method of claim 18, wherein the switch is one of a transistor and a diode.

20. The method of claim 15, wherein the gate line reference voltage is a DC voltage.

21. The method of claim 15, further comprising calculating a compensated voltage by adding the voltage compensation value to the gate line reference voltage.

22. The method of claim 21, wherein the compensated voltage is applied to the gate line during a second frame.

23. The method of claim 21, wherein calculating of the compensated voltage is performed periodically.

* * * * *